US009101239B2

(12) United States Patent
Cavarec et al.

(10) Patent No.: US 9,101,239 B2
(45) Date of Patent: Aug. 11, 2015

(54) MOTORIZED CARRIAGE FOR A CURTAIN AND CONCEALMENT FACILITY COMPRISING SUCH A CARRIAGE

(75) Inventors: Pierre-Emmanuel Cavarec, Mont Saxonnex (FR); Sebastien Lemaitre, Cluses (FR); Remi Sourain, Domancy (FR)

(73) Assignee: SOMFY SAS, Cluses (FR)

( * ) Notice: Subject to any disclaimer, the term of this patent is extended or adjusted under 35 U.S.C. 154(b) by 207 days.

(21) Appl. No.: 13/808,377

(22) PCT Filed: Jul. 6, 2011

(86) PCT No.: PCT/FR2011/051606

§ 371 (c)(1), (2), (4) Date: Mar. 18, 2013

(87) PCT Pub. No.: WO2012/004530

PCT Pub. Date: Jan. 12, 2012

(65) Prior Publication Data

US 2013/0160955 A1 Jun. 27, 2013

(30) Foreign Application Priority Data

Jul. 6, 2010 (FR) ..... 10 55472

(51) Int. Cl.
*A47H 5/02* (2006.01)
*A47H 5/032* (2006.01)

(52) U.S. Cl.
CPC ..... *A47H 5/02* (2013.01); *A47H 5/0325* (2013.01)

(58) Field of Classification Search
CPC ..... A47H 5/0325; A47H 5/02; A47H 15/02; A47H 15/04
USPC ..... 160/266, 340, 341, 333, 345; 16/87.4 R, 16/87.2, 93 R, 93 D, 94 R, 94 D, 91, 97, 16/107, 106, 102, 96 D
See application file for complete search history.

(56) References Cited

U.S. PATENT DOCUMENTS 2,664,598 A * 1/1954 Greig ..... 49/420
3,337,903 A * 8/1967 Kenney ..... 16/87.4 R
3,620,284 A 11/1971 Shayman (Continued)

FOREIGN PATENT DOCUMENTS

DE 2436753 A1 3/1975
DE 2532904 2/1977

(Continued)

OTHER PUBLICATIONS

International Search Report, dated Nov. 3, 2011, which issued during the prosecution of International Patent Application No. PCT/FR2011/051606, of which the present application is the national phase.

*Primary Examiner* — Katherine Mitchell
*Assistant Examiner* — Johnnie A Shablack
(74) *Attorney, Agent, or Firm* — Troutman Sanders LLP

(57) ABSTRACT

A motorized carriage for opening/closing a screen moves along a rail by means of a friction wheel that is rotated by a motor and is in contact with at least one running surface of the rail. The contact force between the friction wheel and the running surface can be regulated by a presser means that enables the contact force to be varied according to a resistive force that depends on the load pulled or pushed by the carriage as it moves.

9 Claims, 3 Drawing Sheets

(56) References Cited

U.S. PATENT DOCUMENTS

| | | | | |
|---|---|---|---|---|
| 3,732,914 | A * | 5/1973 | Flageollet | 160/331 |
| 4,126,921 | A * | 11/1978 | Pape et al. | 29/281.1 |
| 4,141,105 | A * | 2/1979 | Gonon | 16/87.6 R |
| 4,698,876 | A * | 10/1987 | Karita | 16/102 |
| 4,915,153 | A * | 4/1990 | Toti | 160/84.04 |
| 5,035,025 | A * | 7/1991 | Morris et al. | 16/97 |
| 5,542,149 | A * | 8/1996 | Yu | 16/87.4 R |
| 5,676,189 | A * | 10/1997 | Zeeb | 160/331 |
| 6,052,867 | A * | 4/2000 | Haab et al. | 16/87.6 R |
| 6,058,656 | A * | 5/2000 | Bischof et al. | 49/409 |
| 6,085,826 | A * | 7/2000 | Maesaki | 160/345 |
| 6,983,512 | B2 * | 1/2006 | De Oliveira | 16/97 |
| 7,293,389 | B2 * | 11/2007 | Jacobs | 49/425 |
| 7,686,063 | B2 * | 3/2010 | Kirby et al. | 160/331 |
| 7,686,064 | B2 * | 3/2010 | Gu | 160/341 |
| 7,699,090 | B2 * | 4/2010 | Vrielink | 160/345 |
| 7,712,258 | B2 * | 5/2010 | Ewing et al. | 49/410 |
| 7,832,052 | B2 * | 11/2010 | Vrielink | 16/87.4 R |
| 7,849,560 | B2 * | 12/2010 | Kelley | 16/105 |
| 8,167,020 | B2 * | 5/2012 | Shanahan et al. | 160/266 |
| 8,393,114 | B2 * | 3/2013 | Haab et al. | 49/425 |
| 8,418,318 | B2 * | 4/2013 | Scharf et al. | 16/106 |
| 8,469,078 | B2 * | 6/2013 | Drew | 160/196.1 |
| 8,522,398 | B2 * | 9/2013 | Haab et al. | 16/105 |
| 8,590,233 | B2 * | 11/2013 | Sprague | 52/243.1 |
| 2004/0025292 | A1 * | 2/2004 | Owens | 16/102 |
| 2005/0172563 | A1 | 8/2005 | Komoda | |
| 2009/0301668 | A1 * | 12/2009 | Kirby et al. | 160/341 |
| 2010/0139037 | A1 * | 6/2010 | Hufen et al. | 16/88 |
| 2013/0074283 | A1 * | 3/2013 | Lagarde | 16/102 |
| 2014/0237769 | A1 * | 8/2014 | Proctor et al. | 16/97 |
| 2014/0251555 | A1 * | 9/2014 | Pelekanos | 160/134 |

FOREIGN PATENT DOCUMENTS

| | | | |
|---|---|---|---|
| JP | 9-327373 | A | 12/1997 |
| JP | 2005-095364 | A | 4/2005 |

* cited by examiner

MOTORIZED CARRIAGE FOR A CURTAIN AND CONCEALMENT FACILITY COMPRISING SUCH A CARRIAGE

CROSS-REFERENCE TO RELATED APPLICATIONS

This application is a National Stage Application of International Application PCT/FR2011/051606 ("PCT '606"), filed Jul. 6, 2011, and published as WO 2012/004530 on Jan. 12, 2012. PCT '606 claims priority to French Patent Application 10 55472, filed Jul. 6, 2010. Both applications are incorporated herein by reference.

TECHNICAL FIELD

The invention relates to a motorized carriage for opening/closing a screen, this carriage being able to move along a rail, as well as a concealment facility for an opening comprising, among others, such a carriage.

BACKGROUND

There are many devices that make it possible to maneuver the opening of a curtain. One of the solutions consists in motorizing the movement of the head carriage whereon is fixed an end of the curtain. The head carriage comprises guide wheels, in general, at least two pairs of wheels, running along running tracks formed along a rail fixed in the vicinity of the ceiling of a room.

Applications JP-A-2005-095364 and JP-A-09-327373 describe a head carriage incorporating a friction wheel driven in rotation by a motor and able to be in contact, over a portion of its periphery, with a running surface formed along a rail. The contact force between the friction wheel and the running surface can be adjusted, statically, by a presser means.

DE-A-24 36 753 teaches to take into account the direction of movement of a carriage in order to adjust the contact force of a zone of friction on a rail. Once the direction of movement of the carriage is established, the contact force is independent of the weight of the curtain.

However, during the movement of a curtain, the required force to be provided to the head carriage in order to drive the curtain, changes as it moves. In order to be able to close the curtain, the motor has to be sized in such a way as to be able pull the curtain at the end of travel, i.e., a substantial force proportional to the total mass of the curtain and able to compensate the elastic reaction of the tensioned curtain. At the beginning of a closing maneuver, the head carriage pulls a low load, as the mass of the curtain is supported by static support carriages. Durant this phase, the head carriage only moves a few support carriages and therefore only a few sections of the curtain, which represents a low weight. Then, the head carriage drives more and more support carriages. Consequently, it pulls a higher curtain mass. At the end of travel, the carriage needs to provide a substantial force, in particular proportional to the total mass of the curtain. Therefore, at the beginning of the closing of the curtain, the motor is oversized, which results in a poor output of the device and, therefore, has a negative influence on the consumption of the motor. This disadvantage is even further penalizing when the motor is powered by an autonomous source of energy, the case for which the optimization of the consumption is sought.

SUMMARY

The invention proposes a motorized carriage for a curtain making it possible to optimize the energy consumption of the motor.

To this effect, the invention relates to a motorized carriage for opening/closing a screen, with this carriage able to move along a rail thanks to a friction wheel driven in rotation by a motor and in contact with at least one running surface of the rail, the contact force between the friction wheel and the running surface able to be adjusted by a presser means, characterized in that the presser means makes it possible to vary the contact force according to a resistive force which depends on the change of the load pulled or pushed by the carriage as it moves.

Thus, the carriage is similar to the aforementioned carriages of prior art mentioned except for the presser means which is designed in such a way as to allow for the variation of the contact force according to the change in the load pulled or pushed by the carriage as it moves, in particular the weight of the deployed portion of the curtain and associated carriages.

According to advantageous but non-mandatory aspects of the invention, such a carriage can incorporate one or several of the following features, taken in any combination that is technically admissible:

- The presser means enables the distance between the axis of rotation of the friction wheel and the running surface of the rail to be modified.
- The friction wheel is accommodated in a housing pivoting around an axis parallel to the axis of rotation of the friction wheel.
- The carriage comprises at least two pairs of guide wheels running on tracks of the rail, while the presser means comprises an arm kinetically connected to a housing of the carriage and mobile in relation to the latter, between a first rest position where it imposes on the housing a first position in relation to the rail, such that the contact force has a first value, and at least one second position of movement where it imposes on the housing a second position in relation to the rail, such that the contact force has a second value and that the presser means modifies the separation of the axes of rotation of the two pairs of guide wheels by varying the contact force, when the arm passes from its first position to its second position, or reciprocally.
- The pivoting axis of the housing is confounded with the axis of rotation of the wheels of a pair of guide wheels.
- The housing accommodates the friction wheel and one of the two pairs of guide wheels is supported by the mobile arm. In this case, the mobile arm of the presser means can pivot in relation to the housing around an axis parallel to the axis of the friction wheel, according to the change in the resistive force. Alternatively, the mobile arm of the presser means is in contact with a guide cam that makes it possible to modify the position of the presser means in relation to the running surface.
- A motor for driving the friction wheel is powered by an autonomous source of energy.

Generally, the carriage comprises at least two pairs of guide wheels running on tracks of the rail. Preferably, the presser means makes it possible to bring the friction wheel closer to the rail by modifying the vertical distance between the axis of the friction wheel and a plane passing through the contacts of the guide wheels with the tracks of the rail. This measurement can be adjusted via simple means. In reality, this entails a low variation in this value since, when operating, the friction wheel is continuously in contact with the rail. This variation is in fact directly proportional to the wheel deformation due to the increase in the pressure force.

Among the simple means for adjusting, one solution consists in that the presser means modifies the separation of the two pairs of guide wheels in order to vary the contact force between the friction wheel and the corresponding running surface of the rail.

Advantageously, the presser means comprises a mobile element in relation to a housing supporting the friction wheel, with the mobile element, whereon is hooked the curtain to be moved, supporting one of the two pairs of guide wheels. With this structure, the pair of guide wheels associated with the mobile element is slowed proportionally to the curtain mass pulled or pushed, which naturally tends to separate or bring closer together the two pairs of guide wheels. Also, thanks to pivots or cams, the friction wheel can then be thrust, more or less strongly, on the running surface according to the separation of the guide wheels, which results in a variation in the contact force between the friction wheel and the running surface.

The device of the invention is particularly adapted to a motorized system powered by an autonomous source of energy.

The invention further relates to a concealment facility for an opening comprising a rail, a motorized carriage and a curtain hooked to the motorized carriage, characterized in that the carriage is such as mentioned hereinabove and its friction wheel is in contact with the running surface of the rail and exerts on this surface a contact force that varies according to the resistive force.

BRIEF DESCRIPTION OF THE DRAWINGS

The invention shall be better understood when reading the following description, provided solely by way of example and in reference to the annexed drawings wherein.

DETAILED DESCRIPTION

Figure 1:
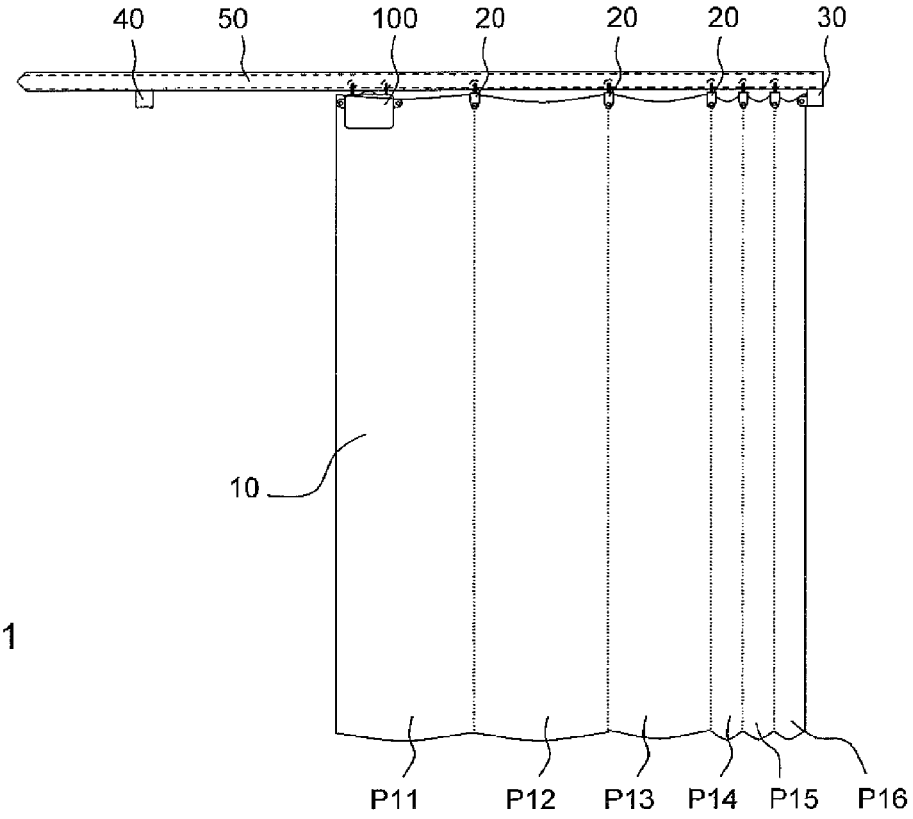
FIG. 1 is a drawing of a curtain integrating a motorized carriage from prior art.

FIG. 1 shows a known system for motorizing a curtain 10 within a concealment facility of a window which is not shown for reasons of clarity in the drawing. The curtain, which forms a concealment screen, is suspended from carriages of two types, 20 and 100 thanks to hooks not shown. These carriages include guide wheels running on running tracks arranged along a rail 50 fixed in the vicinity of the ceiling of a room. As such, the curtain can freely move along the rail. At one of its top ends, the curtain is hooked to a stop 30 fixed to the rail. At its other top end, the curtain is hooked to a motorized head carriage 100 of which the structure is detailed in FIGS. 2 and 3. The curtain 10 is comprised of sections of fabric P11, P12, P13, P14, P15, P16 that correspond each to the surface of fabric hanging between two support carriages 20.

The closing of the curtain takes place by moving the curtain towards the left in FIG. 1. Its opening takes place by moving it towards the right.

In this description, the words "top" and "bottom", "upper" and "lower" are used in reference to an operating configuration of the system of FIG. 1. The words "front" and "rear" relate to the direction of movement of the curtain 10 as it is closing. As such, a "front" portion is located on the left of FIG. 1 in relation to a "rear" portion.

During a closing movement of the curtain, the mass pulled changes as the head carriage 100 moves the support carriages 20 and the sections of fabric P11 to P16. The support carriages are driven thanks to the fabric tensioned between two support carriages or thanks to a connector connecting two consecutive support carriages, for example, a chain. As such, for this movement, the head carriage begins by tensioning the first section P11, then drives the first support carriage 20, then tensions the second section P12, then drives the second support carriage 20 and so on. At the beginning of the maneuver, the last sections P12, P13, P14, P15, P16 do not move, they are supported by static support carriages 20. The mass of these last sections is distributed over these carriages and is not pulled by the head carriage 100. As such, the pulled mass by the head carriage increases as the curtain 10 closes. The change in the force required to provide for the closing of the curtain is not regular. It increases substantially towards the end of travel in order to move the total mass of the curtain but also in order to compensate the elastic reaction of the curtain in traction.

During an opening movement of the curtain, the mass pushed also changes as the head carriage 100 pushes the support carriages, with the sections P11 to P16 being loose between two support carriages 20. In this case, the head carriage begins by loosening the first section P11, then pushes the first support carriage, then loosens the second section P12, and so on. At the beginning of the maneuver, the last sections P12, P13, P14, P15, P16 do not move, they are supported by static support carriages 20 which support most of the mass of the curtain. Here again, the curtain mass pushed by the head carriage increases as the screen opens. The change in the force required to provide for the opening of the curtain is not regular. It increases substantially towards the end of travel in order to move the total mass of the curtain but also in order to compensate the elastic reaction of the curtain in compression.

In order to stop the closing of the curtain 10, a first solution consists in detecting the tension of the curtain. When the curtain is deployed, the fabric or the connection between a carriage support 20 and another adjacent carriage 20 or 100 is tensioned. Due to the fact that the last section P16 of the curtain is reconnected to the stop 30 fixed on the rail 50, the movement of the motorized head carriage 100 is stopped. This motorized carriage 100 can therefore stop upon detection of an increase in the torque or of a variation in speed.

Alternatively, one solution consists in placing a stop 40 on the trajectory of the head carriage. The latter thus stops as soon as it encounters the stop 40. The principle of detection can be analogous to the preceding solution. This second solution has the advantage of controlling the stop position of the head carriage and also it makes it possible to avoid tensioning the fabric of the curtain 100, which decreases the risk of damaging it. This solution is particularly suited for a double curtain structure that comes to close at the center of the rail or at desired positions. In the second case, the two curtains can have a different course of travel. The first curtain can, for example, have a course of travel corresponding to one-third of the length of the rail while the second curtain would have a course of travel corresponding to two-thirds. Indeed, the same stop 40 can be used for the two curtains, as such providing the control of the stop position for the two head carriages. This common stop can also be used to re-synchronize the two motorized carriages which is more pertinent in the case of a central stop.

The stopping of the curtain at the opening occurs when all of the support carriages are piled together and stop against the stop 30. The detection of this stop by the motorized carriage 100 is analogous to the detection described previously.

The observations hereinabove also apply to a concealment facility in accordance with the invention incorporating a carriage such as is shown in FIGS. 4 to 8 and described hereinafter.

Figure 3:
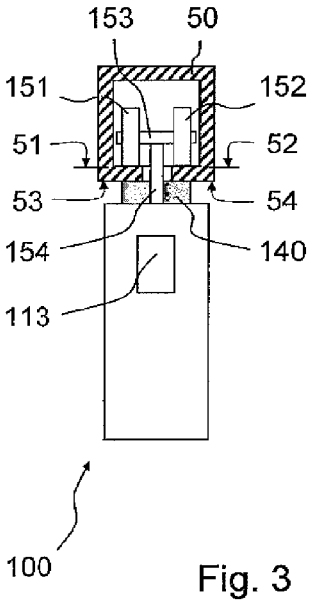
FIG. 3 is a diagrammatical side view of the carriage and of the rail shown in FIG. 2.
Figure 2:
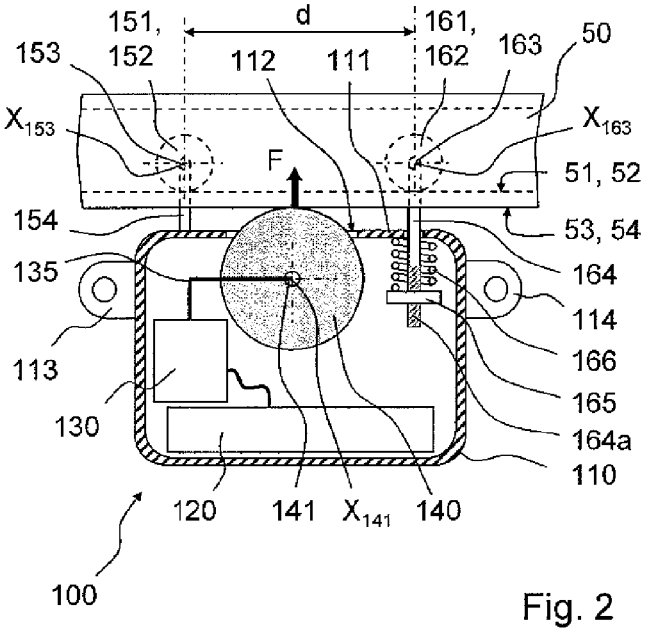
FIG. 2 is a diagrammatical view, as a longitudinal cross-section, of a motorized carriage from prior art in place in the vicinity of a guide rail shown as an exterior view.

FIGS. 2 and 3 show a known motorized carriage. The motorized carriage 100 comprises a housing 110 suspended from the rail 50 with "square" section. The latter is split longitudinally over its lower surface, forming as such, on either side of the slot 55, two internal tracks 51 and 52 and two external running surfaces 53 and 54. The internal tracks are intended to receive through support and guide the guide wheels of the motorized carriage and support carriages. The housing 110 is suspended, at the front, from a first pair of guide wheels 151, 152 running respectively on the tracks 51, 52 and, at the rear, from a second pair of guide wheels running respectively on the tracks 51, 52. Only one of these wheels is visible, in FIG. 2, with the reference 162. The other rear wheel 161 is located behind the wheel 151 in what is shown in FIG. 3 and behind the wheel 162 in what is shown in FIG. 2.

The carriage 100 moves along the rail 50 thanks to a friction wheel 140, accommodated in the housing 110, running on the running surfaces 53 and 54. The axis $X_{141}$ of rotation of the wheel 140 is substantially perpendicular to the direction of movement of the carriage along the rail and substantially parallel to the axes of the guide wheels. The motorization of the carriage is carried out by an electric motor 130 powered by an autonomous source of energy 120, such as batteries. The motor 130 drives in rotation the friction wheel 140 via a transmission 135 shown diagrammatically in FIG. 2.

In order for the carriage to drive a determined load, it is necessary that the contact force between the friction wheel 140 and the running surfaces 53 and 54 is enough so that the wheel 140 does not spin. Thanks to a presser means, this force can be adjusted. The presser means described in this solution is incorporated into one of the suspensions of the housing 110. The first front suspension comprises the front wheels 151 and 152 rotating around an axis $X_{153}$ materialized by a front shaft 153. A front suspension arm 154 passes through the slot 55 and connects the center of the front shaft 153 to the housing 110. The second rear suspension is comprised of rear wheels 161 and 162 rotating around an axis $X_{163}$ materialized by a rear shaft 163. A rear suspension arm 164 passes through the slot 55 and connects the center of the rear shaft 163 to the housing 110, at a longitudinal distance d from the pair of front wheels.

Contrary to the front arm 154, the second rear arm 164 is not directly fixed on the housing 110. This rear arm 164 passes through a wall of the housing. It comprises a threading **164*a* at an end in such a way as to cooperate with a nut 165. A coiled spring 166, centered by the rear arm, presses, on one side, against an internal wall of the housing and, on the other side, against the nut 165. Consequently, the screwing of the nut 165 on the threading 164*a* of the rear arm 164 compresses the spring 166 which transmits the compression force onto the internal wall of the housing 110. As such, the housing pivots around the X $axis_{153}$ of the front shaft 153 in such a way as to approach the rear of the housing 10 of the rail 50. This movement is limited by the friction wheel 140 housed between the two arms and of which a portion extends beyond the top surface 111 of the housing, thanks to a slot 112 arranged on this face. Indeed, this friction wheel, which rotates around the X $axis_{141}$ materialized by a shaft 141 integral with the housing, comes to press against the running surfaces 53 and 54 of the rail, as such blocking the pivoting of the housing around the axis $X_{153}$. As such, the elements 164, 165 and 166 and the internal surface of the housing 110 together constitute the presser means of the wheel 140 against the running surfaces 53 and 54**.

The variation of the compression force of the spring 166 makes it possible to vary the contact force between the friction wheel 140 and the running surfaces 53 and 54. This contact force is the result of a double contact which is exerted, on the one hand, between the guide wheels 151, 152, 161 and 162 and the tracks 51, 52 of the rail 50 and, on the other hand, between a portion of the periphery of the friction wheel 140 and the running surfaces 53, 54. The intensity of the contact force exerted by the friction wheel 140 depends on its position in relation to the rail 50. Its position varies according to the pivoting angle of the housing in relation to the axis X153. The presser means 110-164-165-166 allows this angle to be adjusted, and therefore to directly modify the contact force. The pivoting angle or the variation in the position of the wheel in relation to the rail is low. Indeed, during operation, the friction wheel is continuously in contact with the rail. However, it is the crushing of the wheel against the running surfaces which generates the increase in the contact force. Consequently, the crushing height defines the pivoting angle and the variation in the position of the wheel in relation to the rail. The wheel is more preferably made of a relatively flexible material which makes it possible to increase the crushing height and to increase the contact surface.

Moreover, the housing 110 comprises a first lug 113, at the front of the carriage and a second lug 114, at the rear of the carriage. These two lugs make it possible to fasten hooks not shown and fixed on the top of the first section P11 of the curtain.

With the device described hereinabove, the contact force must be adjusted in order to drive the total mass of the curtain 10 provided with support carriages 20, i.e., the load to be pulled at the end of curtain movement. Once adjusted, this force does not vary during the movement. As such, at the beginning of a curtain movement, the contact force is stronger than what is required. However, as the electrical consumption of the motor is directly proportional to this contact force, the latter is penalized during most of the travel of the curtain.

Figure 4:
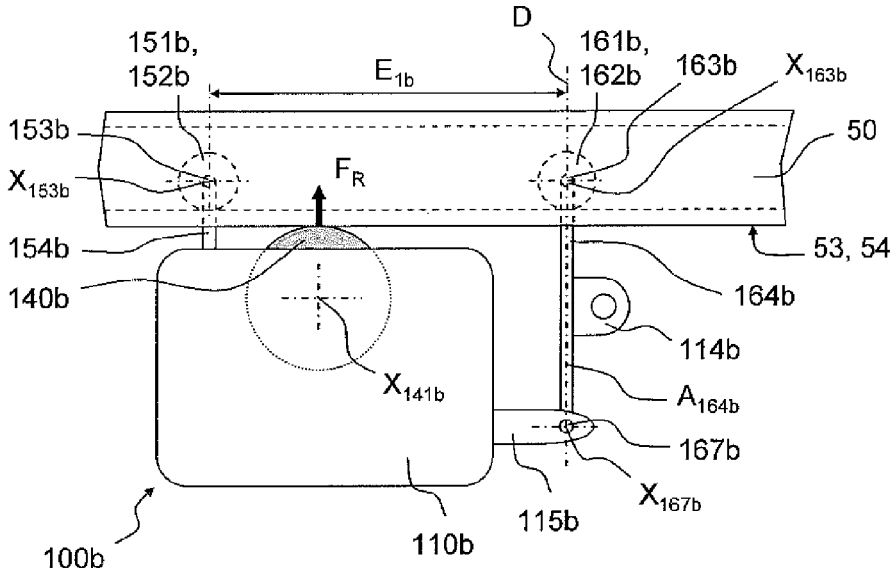
FIGS. 4 to 6 are front views showing the operation of a motorized carriage in accordance with an example of the invention.
Figure 5:
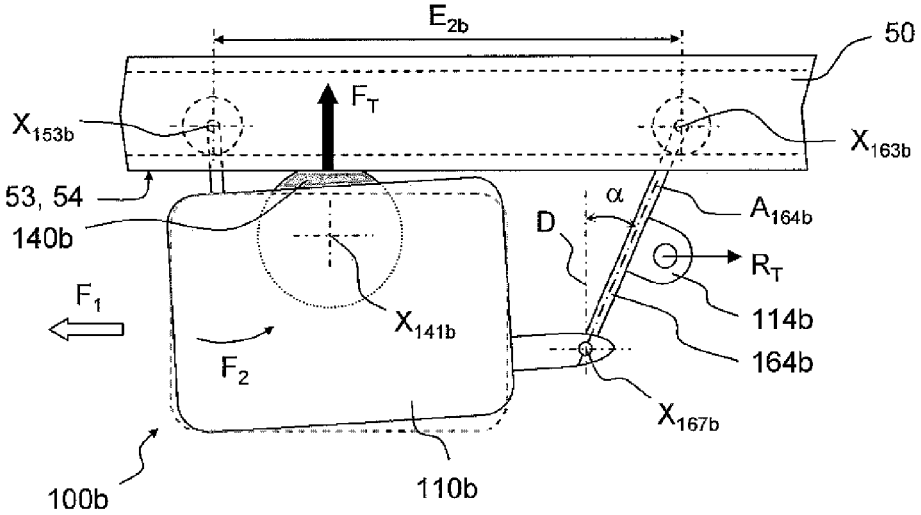
Figure 6:
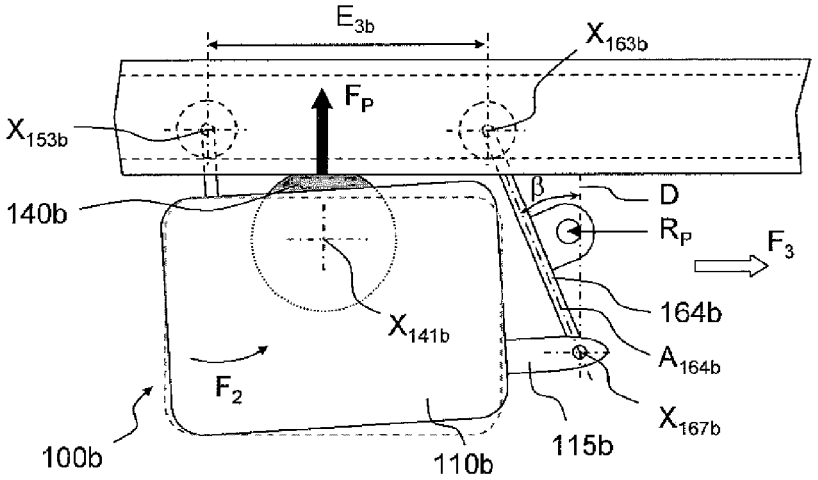

FIGS. 4 to 6 show an example of the invention. The global structure of the motorized carriage **100*b* is similar to that of the motorized carriage 100 of prior art described previously, except for the presser means. The elements of the motorized carriage according to this example are referenced by the same numbers as those of the motorized carriage of prior art to which the index "b" is added. The elements that are identical to those in FIGS. 1 to 3 are not described in detail. The carriage 100*b* comprises a motor and a transmission not shown and similar to the elements 130 and 135 which drive a friction wheel 140*b*** in rotation.

In this example, the presser means of the friction wheel **140*b* on the running surfaces 53 and 54 of the rail 50 is carried out by a rear fastening device of the motorized carriage 100*b*. As such, the rear suspension arm 164*b* of the carriage 100*b* comprises an end similar to that of the rear arm 164** on rail but is different at its other end.

On the side of the rail 50, the rear arm **164*b* is reconnected to a rear shaft 163*b* supporting two rear guide wheels 161*b* and 162*b*. The rear arm 164*b* is therefore used to support the carriage 100*b* under the rail 50, such as the rear arm 164 of the carriage 100, in cooperation with a front arm 154*b* identical to the front arm 154. The guide wheels 151*b*, 152*b*, 161*b* and 162*b*, mounted rotatingly around axes $X_{153b}$ and $X_{163b}$ at the top portion of the arms 154***b* and 164*b*, are both used to suspend the carriage 100*b* and to guide it along the rail 50.

On the other side, the rear arm 164*b* is articulated around a lug 115*b* integral with the housing 110*b* of the motorized carriage 100*b*, around an axis $X_{167b}$ materialized by a second shaft 167*b*. Consequently, the rear arm 164*b* can pivot around the axis $X_{167b}$ which is parallel to the axes of the guide wheels 151*b*, 152*b*, 161*b* and 162*b* and perpendicular to the direction of movement of the carriage 100*b* along the rail 50. Moreover, the rear arm 164*b* supports a lug 114*b* intended for the fastening of a hook, not shown and fixed on the top of the first section P11 of the curtain.

The principle of the variation in the contact force according to the change in the load pulled or pushed by the carriage as it moves is shown in FIGS. 4 to 6.

FIG. 4 shows the position of the motorized carriage 100*b* at rest. The rear arm 164*b* is in vertical position, with its longitudinal axis $A_{164b}$ confounded with a vertical straight line D cutting the axis $X_{167b}$. The axes $X_{153b}$ and $X_{163b}$ of the two pairs of guide wheels 151*b*/152*b* and 161*b*/162*b* are separated by a distance $E_{1b}$, along the rail 50. The friction wheel 140*b* exerts a contact force $F_R$ distributed over the running surfaces 53 and 54.

FIG. 5 shows the closing of the curtain. The carriage 100*b* moves in the direction of the arrow $F_1$. The friction wheel 140*b* runs along running surfaces 53 and 54 by rotating around an axis $X_{141b}$, as such provoking the movement of the carriage 100*b* which drives, in turn, the curtain via the lug 114*b*. As the curtain mass pulled $M_T$ increases, the resistive force $R_T$ to the movement of the carriage 100*b* increases, the rear arm 164*b* rotates, in the clockwise direction in FIG. 5 around the pivoting axis $X_{167b}$. This rotation increases the value of an angle $\alpha$ defined between the vertical straight line D cutting the axis $X_{167b}$ and the longitudinal axis $A_{164b}$ of the rear arm 164*b*. The rear arm 164*b* is then beyond the straight line D in relation to the housing 110*b* of the carriage 100*b*.

This rotation causes, on the one hand, the separation of the two pairs of wheels 151*b*/152*b* and 161*b*/162*b* in relation to one another and, on the other hand, the pivoting of the housing 110*b* around the X $axis_{153b}$, in the anti-clockwise direction shown by the arrow $F_2$. The distance between the axes of rotation $X_{153b}$ and $X_{163b}$ of the pairs of guide wheels increases to a value $E_{2b}$ greater than the value $E_{1b}$. The carriage 100*b* as such passes from the configuration shown by the housing 110*b* as a dotted line to the configuration as a dashed line in FIG. 5.

These movements have for consequence the bringing the axis $X_{141b}$ of rotation of the friction wheel 140*b* and of the rail 50 closer together and therefore the increase in the contact force $F_T$ between the friction wheel and the running surfaces 53 and 54. The increase in this contact force makes it possible to increase the pulling force of the motorized carriage 100*b*. With this mechanism, the contact force adjusts to the pulling force required to move a defined curtain mass $M_T$ and overcome the corresponding resistive force $R_T$. Thus, during the closing of the screen, the contact force self-adjusts, in particular according to the change in the curtain mass to be pulled. The consumption of the motor is thus optimized.

FIG. 6 shows the opening of the curtain. The operating principle is analogous to that of the closing of the curtain. The friction wheel 140*b* runs along running surfaces 53 and 54, as such provoking the movement in the direction of the arrow $F_3$ of the carriage 100*b* which pushes, in turn, the curtain via the lug 114*b*. As the curtain mass $M_T$ pushed $M_P$ increases the resistive force $R_P$ increases and the rear arm 164*b* rotates, in the anti-clockwise direction around the pivoting axis $X_{167b}$. This rotation increases the absolute value of an angle $\beta$ defined between the straight line D and the axis $A_{164b}$. The rear arm 164*b* is then between the straight line D and the housing 110*b*.

This rotation causes, on the one hand, the bringing closer together of the two pairs of guide wheels 151*b*/152*b* and 161*b*/162*b* and, on the other hand, the pivoting of the housing 110*b* around the X $axis_{153b}$, in the anti-clockwise direction shown by the arrow $F_2$. The distance between the axes $X_{153b}$ and $X_{163b}$ then decreases to a value $E_{3b}$ less than the value $E_{1b}$. The carriage 100*b* passes from the configuration shown by the housing 110*b* as a dotted line to the configuration as a dashed line in FIG. 6. These movements have for consequence the bringing of the axis $X_{141b}$ of rotation of the friction wheel 140*b* and of the rail 50 closer together and therefore the increase in the contact force $F_P$ between the friction wheel and the running surfaces. The contact force then self-adjusts in the same way as previously.

Figure 7:
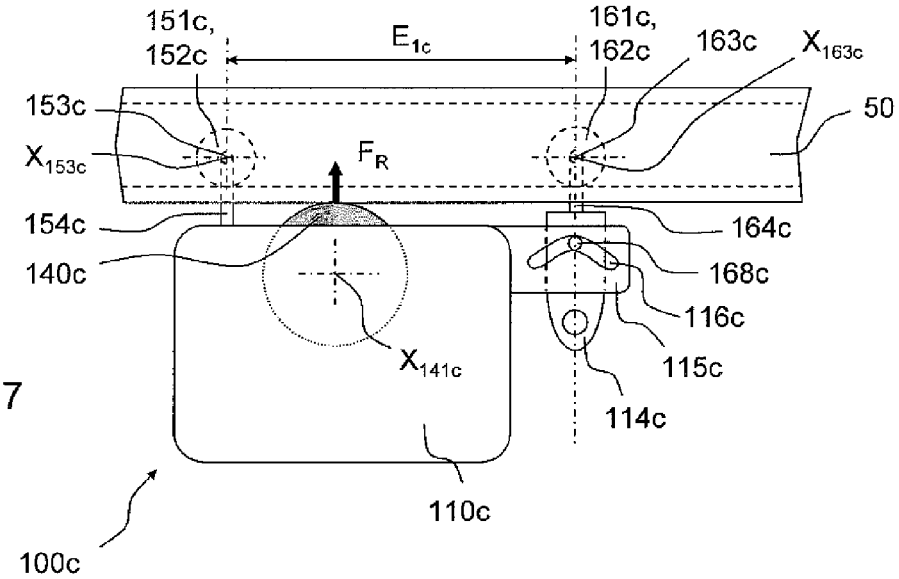
FIGS. 7 to 8 are front views showing the operation of a motorized carriage in accordance with another example of the invention.
Figure 8:
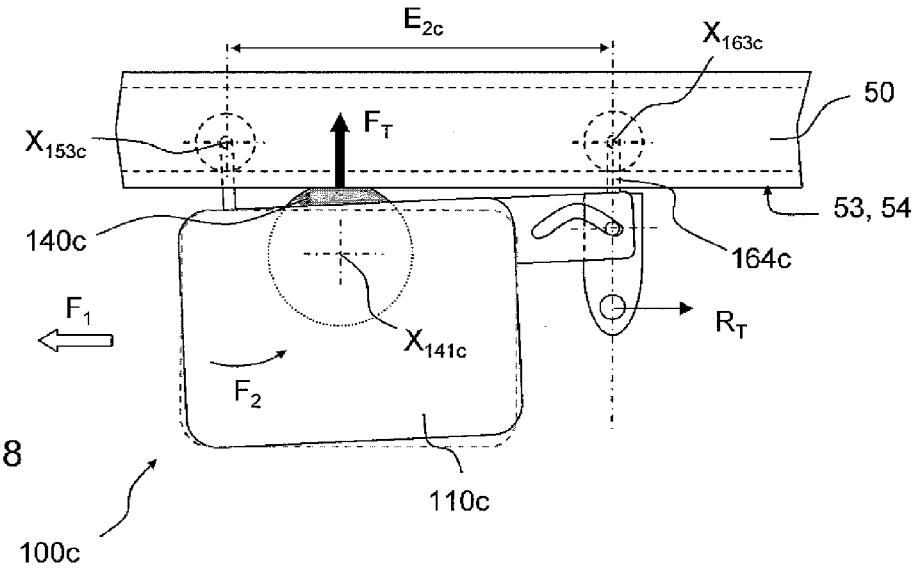

FIGS. 7 and 8 show another example of the invention. The structure of the motorized carriage 100*c* is similar to that of the motorized carriage 100 of prior art described previously, except for the presser means. The elements of the motorized carriage according to this example are referenced by the same numbers of the motorized carriage of prior art to which is added the index "c". The elements that are identical to those in FIGS. 1 to 3 are not described in detail. The carriage 100*c* comprises a motor and a transmission not shown and analogues to the elements 130 and 135 which drive a friction wheel 140*b* in rotation.

The presser means of the friction wheel 140*b* on the running surfaces 53 and 54 of the rail 50 is also carried out by a rear fastening device of the motorized carriage 100*c*. The rear suspension arm 164*c* of the carriage 100*c* comprises an end similar to that of the rear arm 164 on the rail but is different at its other end.

On the side of the rail 50, the rear arm 164*c* is reconnected to a rear shaft 163*c* supporting two rear guide wheels 161*c* and 162*c*. The rear wheels 161*c* and 162*c* are also used to suspend the carriage 100*c* under the rail 50, in conjunction with the front wheels 151*c* and 152*c* mounted rotatingly at the upper end of a front suspension arm 154*c* identical to the front arm 154.

In the median portion, the rear arm 164*c* carries a pin 168*c* extending according to a direction parallel to the axes $X_{153c}$ and $X_{163c}$ of rotation of the guide wheels. This pin cooperates with a guide path 116*c*, in the shape of an inverted "V", arranged on a lug 115*c* integral with the housing 110*c* of the motorized carriage 100*c*. In practice, the guide path 116*c* is formed by a hole cut in the lug 115*c*. Advantageously, the arm comprises two pins, arranged on either side of the arm. In this case, the housing is integral with two lugs 115*c* each integrating one guide path associated with each pin. Moreover, the rear arm 164*c* is extended, opposite the rear wheels 161*c*, 162*c* by a lug 114*c* intended for the fastening of a hook not shown fixed on the top of the first section P11 of the curtain.

As in the above example, the adjustment of the contact force between the friction wheel and the running surface is obtained by varying the separation between the two pairs of wheels 151*c*/152*c* and 161*c*/162*c*.

FIG. 7 shows the position of the motorized carriage 100*c* at rest. The pin 168*c* is located at the top and in the middle of the guide path 116*c* in the shape of an inverted V. The two pairs of wheels 151*c*/152*c* and 161*c*/162*c* are separated by a distance $E_{1c}$. The friction wheel 140*c* exerts a force $F_R$ distributed over the running surfaces 53 and 54.

FIG. 8 shows the closing of the curtain. The friction wheel runs along running surfaces by rotating around an axis $X_{141c}$, as such provoking the movement of the carriage 100*c* in the direction of the arrow $F_1$, which drives the curtain via the lug 114*c*. As the curtain mass pulled $M_T$ increases the resistive force $R_T$ increases and the rear arm 164*c* moves horizontally in the opposite direction of the movement of the carriage. The movement of the carriage 100*c* in relation to the lug 114*c* is a translation along one of the straight branches of the guide path 116*c*. The path 116*c* therefore constitutes a guide cam of the rear arm 164*c*, by the intermediary of the pin 168*c*. This movement as such provokes the separation of the two pairs of wheels 151*c*/152*c* and 161*c*/162*c* which reach a position wherein their axes of rotation $X_{153c}$ and $X_{163c}$ are separated by a distance $E_{2c}$ greater than the distance $E_{1c}$. At the same time, thanks to the cooperation between the pin 168*c* and the guide path 116*c*, this translation drives the pivoting of the housing 110*c* around the axis $X_{153c}$, in the direction of the arrow $F_2$. The carriage 100*c* as such passes from the configuration shown by the housing 110*b* as a dotted line to the configuration as a dashed line in FIG. 8. As for the previous example, these movements have for consequence the bringing the axis $X_{141c}$ of rotation of the friction wheel closer to the rail and therefore increase the contact force $F_T$ between the friction wheel 140*c* and the running surfaces 53 and 54. The contact force then self-adjusts in the same way.

For the opening of the curtain, the reasoning is the same except that the two pairs of wheels 151*c*/152*c* and 161*c*/162*c* come closer together. The pin then cooperates with the other branch of the inverted "V", in a manner comparable to that which is described in reference to FIG. 6.

As an alternative to the previously described examples, the contact force $F_R$ between the friction wheel 140*b* or 140*c* and the running surfaces 53 and 54 in at rest position can be adjusted. For example, a means can be provided that adjusts the height of one of the suspension arms 154*b*, 164*b*, 154*c* or 164*c* connected to the guide wheels. The adjusting solution of prior art described in FIGS. 2 and 3 can also be transposed.

In order to return the carriage to a balanced or at rest position, the solutions described consist in using the reactive force generated following the compression of the friction wheel against the running surfaces. Alternatively, return means can be provided, such as one or several springs, making it possible to return the mobile member of presser means to a balanced position.

Regardless of the example or the alternative under consideration, the presser means of the carriage make it possible to take into account the change in the weight of the pulled or pushed portion of the curtain, therefore the change in the load, by consequently adjusting the contact force. Indeed, the higher the weight of the curtain, the more the resistive force increases and the more the mobile arm 164*b*, 164*c* or equivalent is moved, in relation to housing 110*b* or 110*c* and starting from the same at rest position, which induces a corresponding increase in the contact force.

In the examples described hereinabove, the motor for driving the friction wheel 140*b* or 140*c* is powered by an autonomous source of energy, analogous to the source 120 shown in FIG. 2, for example a set of batteries.

Likewise, it is described that the front top end of the curtain is hooked to the rear arm of the carriage. For aesthetic reasons, this top end of the curtain can also be fastened to the housing of the carriage in such a way as to conceal it. As such, a lug can extend at the front of the carriage in a manner analogous to the lug 113 in prior art. However, an operating clearance must be provided between the front fastening lug connected to the housing and the rear fastening lug connected to the rear arm.

The invention is described in the case where the zone of friction 140*b* or 140*c* cooperates with two running surfaces 53 and 54. It also applies in the case where this zone cooperates with a single running surface. The invention is not limited to the examples described. Other solutions can be considered in order to vary the contact force according to the change in the load pulled or pushed by the carriage as it moves. Likewise, the change in the contact force can be obtained via simple translation of the housing of the carriage, and more particularly of the friction wheel, towards the rail instead of pivoting it about an axis.

The invention can also adapt to carriages that move along other types of rails that have a different profile. The rail must as such be considered as a guide support of the carriage; its shape is of little importance. The rail can be a rod with circular section truncated by a flat surface on its lower portion in such a way as to form the running track for the friction wheel. For this example, the curtain is hooked to rings surrounding the quasi-circular rod.

In this description, the notion of "load" must be understand in broad terms, also including the effects linked to a change in the load as for example the "inertia" of the screen as it moves. As such, the invention also covers horizontally sliding panels. In this example, the operating principle is inverted. At the beginning of the movement, the force to be provided is substantial since the carriage has to start moving the mobile panel. However, once the screen is driven, the force to be provided decreases thanks to the inertia of the panel. A carriage using the principle of the invention therefore makes it possible to adapt its energy needs according to the movement of the panel.

The invention claimed is:

1. A motorized carriage for opening or closing a screen, said motorized carriage moving along a rail using a friction wheel rotatably mounted in a housing suspended to the rail by suspension arms, said friction wheel being driven in rotation around a first axis by a motor and in contact with at least one running surface of the rail, said motorized carriage comprising:

the suspension arms applying a contact force between the friction wheel and the running surface, wherein one of the suspension arms is movable with respect to the housing and configured to one of increase and decrease the contact force according to a resistive force which depends on the change in the load pulled or pushed by the motorized carriage as it moves, via a rotation of the one suspension arm about an axis parallel to the first axis or a translation of the one suspension arm in a longitudinal direction with respect to the housing.

2. The motorized carriage according to claim 1, wherein the housing pivots with respect to the rail around a second axis parallel to the first axis.

3. The motorized carriage according to claim 1 further comprising a motor driving the friction wheel powered by an autonomous source of energy.

4. The motorized carriage according to claim 1 further comprising:

at least two pairs of guide wheels running on tracks of the rail, wherein the suspension arm is kinetically connected to the housing of the carriage and mobile in relation to the latter between a first at rest position, where it imposes on the housing a first location in relation to the rail such that the contact force has a first value, and at least one second position of movement, where it imposes on the housing a second location in relation to the rail such that the contact force has a second value, and wherein the suspension arm modifies the separation of the axes of rotation of the two pairs of guide wheels by varying the contact force when the arm passes from the first position to at least one of the second positions, or reciprocally.

5. The motorized carriage according to claim 4 wherein the housing pivots around a second axis parallel to the first axis and wherein the pivoting axis of the housing is coextensive with the axis of rotation of the wheels of a pair of guide wheels.

6. The motorized carriage according to claim 4 wherein one of the two pairs of guide wheels is supported by the suspension arm.

7. The motorized carriage according to claim 6 wherein the suspension arm pivots in relation to the housing about an axis parallel to the first axis, according to the change in the resistive force.

8. The motorized carriage according to claim 6 wherein the suspension arm is in contact with a guide cam to modify the position of the suspension arm in relation to the running surface.

9. A concealment facility for an opening comprising:

the rail, the motorized carriage, and the screen hooked to the motorized carriage, wherein the carriage is according to claim 1 and the friction wheel is in contact with at least one running surface of the rail and exerts on the running surface a contact force that varies according to the resistive force.

* * * * *